US006482512B1

(12) United States Patent
Schwartz

(10) Patent No.: US 6,482,512 B1
(45) Date of Patent: Nov. 19, 2002

(54) COLOR BLENDED ALTERNATING COLOR COMPOSITE YARN

(75) Inventor: Nathan G. Schwartz, Newtown Square, PA (US)

(73) Assignee: Textured Yarn Co., Inc., PA (US)

( * ) Notice: Subject to any disclaimer, the term of this patent is extended or adjusted under 35 U.S.C. 154(b) by 105 days.

(21) Appl. No.: 09/690,176

(22) Filed: Oct. 17, 2000

(51) Int. Cl.[7] ..... D01F 6/00
(52) U.S. Cl. ..... 428/364; 428/399
(58) Field of Search ..... 428/399, 364; 57/409; 28/220, 252, 253

(56) References Cited

U.S. PATENT DOCUMENTS

| | | | | | |
|---|---|---|---|---|---|
| 3,983,609 | A | | 10/1976 | Pike | |
| 4,070,815 | A | * | 1/1978 | Negishi et al. | 57/140 J |
| 4,152,885 | A | * | 5/1979 | Cox, Jr. | 57/207 |
| 4,253,299 | A | * | 3/1981 | Burenstein et al. | 57/246 |
| 4,299,015 | A | * | 11/1981 | Marcus | 28/221 |
| 4,644,620 | A | | 2/1987 | Maeda | |
| 4,729,151 | A | | 3/1988 | Runyon et al. | |
| 4,993,218 | A | * | 2/1991 | Schwartz et al. | 57/208 |
| 5,148,586 | A | | 9/1992 | Coons, III | |
| 5,251,363 | A | | 10/1993 | Gerhards et al. | |
| 5,590,447 | A | | 1/1997 | Goineau | |
| 5,613,285 | A | | 3/1997 | Chester et al. | |
| 5,632,139 | A | | 5/1997 | Tate | |
| 5,763,076 | A | * | 6/1998 | Coons et al. | 428/364 |
| 5,996,328 | A | | 12/1999 | King et al. | |

* cited by examiner

*Primary Examiner*—Newton Edwards
(74) *Attorney, Agent, or Firm*—Schnader Harrison Segal & Lewis LLP

(57) ABSTRACT

A composite textured air-entangled multi-filament yarn having two or more continuous filament feed yarns, each of which is of different color or dyeability from the other, each feed yarn being pigmented in a melt-spinning process, pre-dyed, or undyed with different dye affinities which are subsequently dyed, the feed yarns being combined into a composite yarn having repeated color change alternating cycles along its length, and the alternating cycles having between them a lengthwise color difference of about 15–95% or more on the circumferential surface of the yarn in either the red, green or blue primary colors, as measured by spectral analysis, between immediately adjacent lengths thereof, and each adjacent color length being between about 4 inches to 144 inches.

6 Claims, 2 Drawing Sheets

COLOR BLENDED ALTERNATING COLOR COMPOSITE YARN

BACKGROUND OF THE INVENTION

Figure 1:
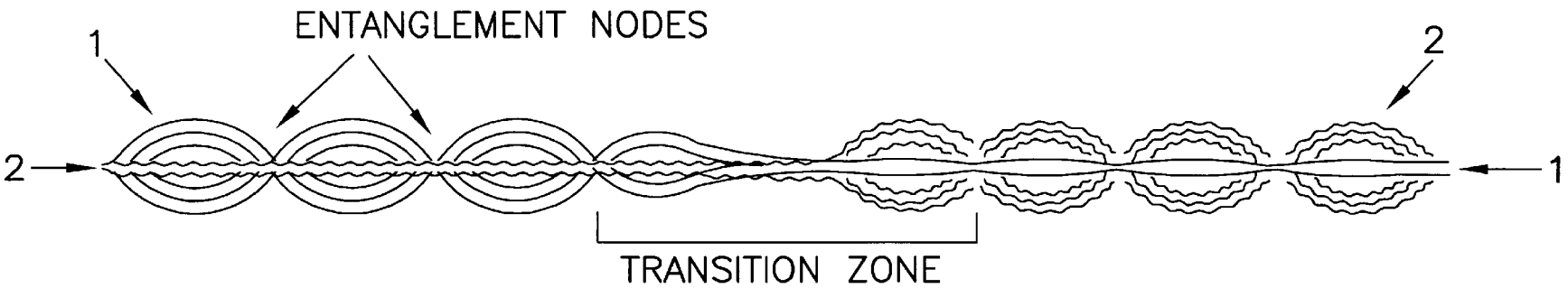

This invention relates to a composite textured air entangled multi-filament yarn. It particularly relates to a textured composite yarn comprising at least two texturized feed yarns having at least two colors, wherein the composite yarn has alternating lengthwise sections exhibiting a major color difference from section to section in either the red, green or blue primary colors, as measured by spectral analysis of immediately adjacent lengths of the composite yarn. The invention further relates to a composite textured air entangled multi-filament yarn wherein the yarn is interlaced so that the multiple filaments are entangled with eacn other, and have entanglement points or nodes of interlaced filaments per meter of about five or more, measured along the composite yarn length.

A novel composite yarn is produced from two or more pre-colored or pigmented continuous filament textured multi-filament yarns. The novel composite yarn is distinguished in appearance by displaying to the observer a repeating color change along the length of the yarn. It demonstrates a more visually distinctive change of color over a greater composite yarn length than has heretofore been obtained in a composite air entangled multi-ply yarn assembled from a plurality of single continuously colored textured yarns.

Textured continuous filament manmade yarns can be single colored yarns or multi-color yarns. Multi-color textured continuous filament yarns are usually produced by either space-dyeing a single textured yarn by applying dyes of different colors along the length of the yarn, or by combining single color dyed or pigmented textured yarns by a conventional textile technique of air entangling, twisting or wrapping.

Air entangled composite yarns made by entangling separate, discreet, or individual textured color yarns are limited in their ability to significantly alter the color of the composite yarn over any meaningful length of the yarn product, as can be done by space-dyeing. Such air entangled yarns are characterized by relatively short lengthwise changes of color, as it has not heretofore been possible to change color for any significant length, from one or more of the constituent colors still present in the composite yarn. Therefore, the visual effect of existing multi-color air entangled yarns made from separate colored yarns has been to have all of the constituent colors more or less present or visible on the surface of the yarn over limited lengthwise distances of only a maximum of about two inches or so.

SUMMARY OF THE INVENTION

In this invention a composite textured entangled yarn is provided consisting of two or more pre-colored individual continuous filament feed yarns, where the overall color appearance of the resulting composite yarn changes its color in repeating cycles along its length by a large and easily detectable percentage in the red, green or blue part of the spectrum. The color change along the composite yarn is much more than has heretofore been produced with a blend of pre-colored textured continuous filament constituent yarns. The composite novel yarn of this invention more closely resembles traditional "space-dyed" textured filament yarns where adjacent lengths of the finished yarn can exhibit longer and larger color changes, because the color changes are achieved by applying various dyes to the yarn at selected places along its length. But this invention avoids the expense and complications of the space-dyeing process.

This invention creates a composite yarn of more contrasting lengthwise color changes. According to this invention, at least two feed yarns are provided. They are made of pre-colored textured continuous filaments by alternately or selectively moving to the yarn surface one or more colored feed yarns, while burying another colored feed yarn, and periodically reversing these positions, as schematically shown in FIG. 1. This is done by:

(1) surfacing one feed yarn to the visible circumferential surface of the composite yarn while mostly submerging within the composite bundle the accompanying feed yarn having one or more contrasting colors;

(2) then reversing the process and surfacing the mostly submerged interior yarn to the visible circumferential surface while mostly submerging within the interior of the composite yarn the formerly visible exterior yarn, and continuing to alternate the surfacing and submerging reversals indefinitely. A heather-like transition zone of nearly equal amounts of each color is created in the resulting composite yarn as the yarns exchange places between submerged and surface locations inside or on the composite yarn product. Each transition zone tends to be a gradually changing blend of the two colors as they exchange interior and exterior places, switching from a more submerged position to a more visible position on the composite yarn circumference, or vice versa, as illustrated in FIG. 1, for example.

DRAWINGS

Figure 2:
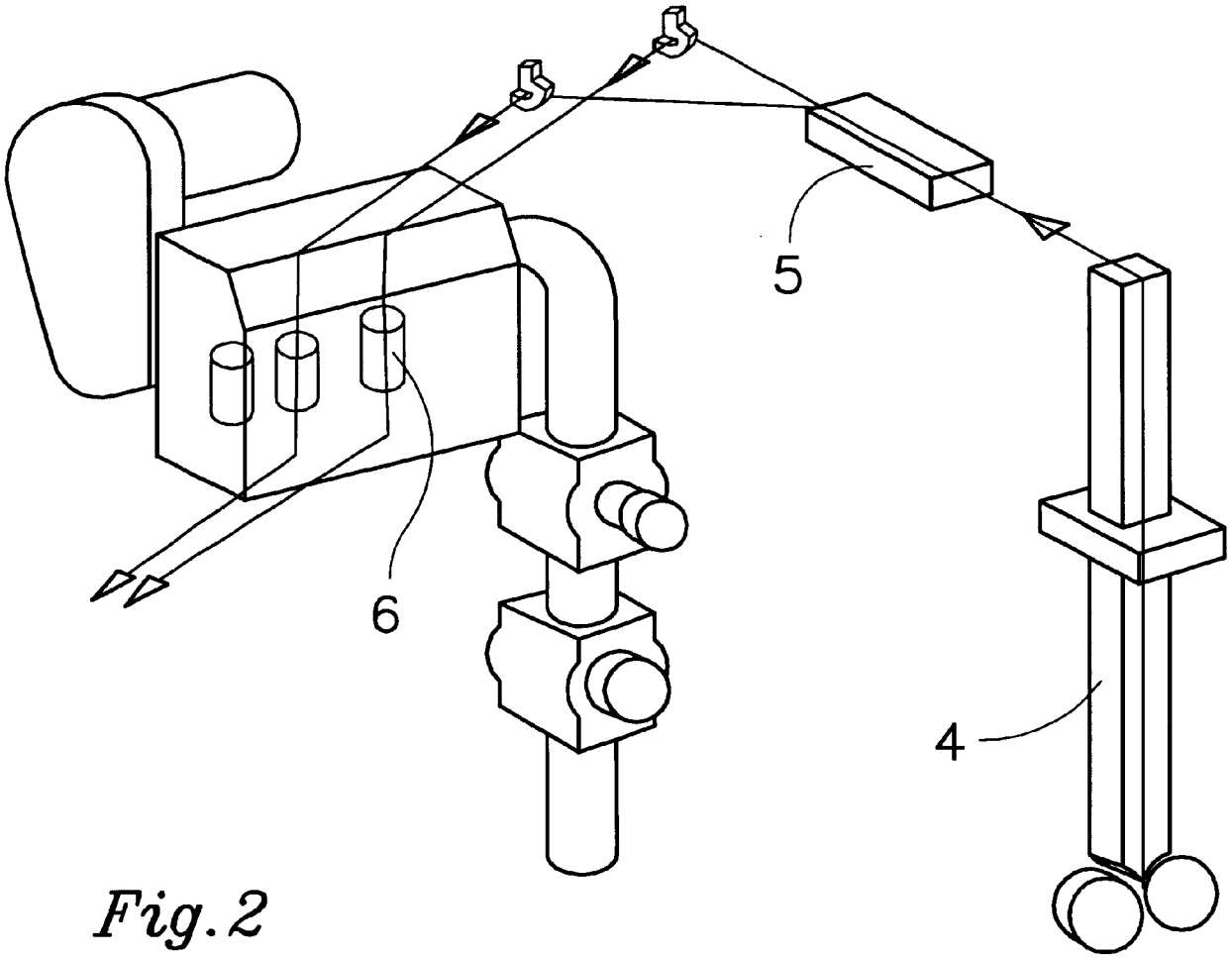

In the drawings:

FIG. 1 is a schematic view of a composite yarn in accordance with this invention, and FIG. 2 is an exploded view of machine components useful in making the yarn.

In the drawing, colored continuous filament feed yarn 2 is shown at the left in a submerged mode, with different colored continuous filament feed yarn 1 at or near the composite yarn surface. The color of yarn 1 is dominant to the eye of the observer. As the yarn 2 approaches the composite yarn surface and the yarn 1 approaches the submerged position in the composite yarn, heather-like color transitions occur in the transition zone 3. When the yarn 2 reaches the composite yarn surface or comes close to it as shown at the right in the drawing, the yarn 2 color predominates and the yarn 2 mostly obscures the color of the yarn 1.

There are many ways to shift the feed yarns back and forth between submerged and exposed positions. A preferred method comprises alternately tensioning one feed yarn while relaxing the tension on the other feed yarn, continuously repeated.

EXAMPLE

In a preferred texturing machine, manufactured by Techniservice, Inc. of Kennett Square, Pennsylvania, portions of which are shown in FIG. 2, two or more colors of pigmented continuous multi-filament polypropylene yarn were placed in a creel and separately fed around a heated godet(s) and fed into a stuffer-box crimping machine 4 (FIG. 2). Upon exit from the crimper's doctor bar, the two separate, pre-colored yarn bundles were alternately subjected to tension and relaxation, with one yarn tensioned and the other relaxed, through a (programmable) tension device or gate 5, FIG. 2. After passing the tension device 5, with each yarn at a different tension, the yarns were fed into an air entanglement jet 6. The entanglementjet 6 combined the different colored and differently tensioned feed yarns into one finished composite yarn. The final composite air entangled yarn was wound on a conventional take-up tube.

In the above described procedure, the pre-colored continuous filament textured yarn that was subjected to higher tension by the tension device or gate 5 was buried to some degree within the composite air entangled yarn, at least partly because of higher applied tension. The pre-colored continuous filament textured yarn that was subjected to lower tension migrated more to the visible surface of the composite yarn and its color accordingly dominated the appearance of the composite yarn at that point. In the continued operation of the apparatus of FIG. 2, the surfacing and submerging were repeated many times along the length of the resulting composite yarn.

The degree of achieved color contrast of at least one primary color, between adjacent lengths of the final composite yarn, is a function of a number of factors including, but not limited to, the amount of tension placed on each selected pre-colored yarn exiting the crimping doctor bar, the amount of bulk or crimp in the yarn created by the texturing or crimping process, the speed of the process, the total denier and denier per filament of the original input materials, and the number of entanglement nodes per unit length of the composite yarn.

Many optical tests were conducted as heretofore described to compare composite yarns of this invention with various trade yarns. The results of the tests are set forth below.

| TRADE YARNS | Primary Red | Red % change in adjacent lengths | Primary Green | Green % change in adjacent lengths | Primary Blue | Blue % change in adjacent lengths |
|---|---|---|---|---|---|---|
| | | BASF Air Entangled Multi-Color Yarn | | | | |
| 10" adjacent lengths | | | | | | |
| Sample 1 | 125 | | 105 | | 91 | |
| Sample 2 | 117 | 6.4 | 100 | 5.0 | 87 | 4.6 |
| Sample 3 | 116 | 0.9 | 100 | 0.0 | 88 | 1.1 |
| Sample 4 | 122 | 4.9 | 102 | 2.0 | 90 | 2.3 |
| Sample 5 | 115 | 6.1 | 96 | 4.2 | 85 | 5.9 |
| 5" adjacent lengths | | | | | | |
| Sample 6 | 115 | | 96 | | 84 | |
| Sample 7 | 121 | 5.2 | 103 | 7.3 | 90 | 7.1 |
| Sample 8 | 123 | 1.6 | 103 | 0 | 89 | 1.1 |
| | | DuPont Air Entangled Multi-Color Yarn | | | | |
| 10" adjacent lengths | | | | | | |
| Sample 1 | 179 | | 153 | | 120 | |
| Sample 2 | 178 | 0.6 | 151 | 1.3 | 117 | 2.6 |
| Sample 3 | 175 | 1.7 | 149 | 1.4 | 114 | 2.6 |
| Sample 4 | 176 | 0.6 | 150 | 0.7 | 115 | 0.9 |

| INVENTION YARNS | Primary Red | Red % change in adjacent lengths | Primary Green | Green % change in adjacent lengths | Primary Blue | Blue % change in adjacent lengths |
|---|---|---|---|---|---|---|
| | | Short Vari-Color Composite Yarn | | | | |
| 18" adjacent lengths of cycles | | | | | | |
| Sample 1 | 50 | | 47 | | 37 | |
| Sample 2 | 87 | 74.0 | 56 | 19.0 | 42 | 12.0 |
| Sample 3 | 62 | 40.0 | 50 | 12.0 | 39 | 8.0 |
| Sample 4 | 83 | 34.0 | 56 | 12.0 | 42 | 8.0 |
| Sample 5 | 51 | 63.0 | 45 | 24.0 | 35 | 17.0 |
| Sample 6 | 98 | 92.0 | 59 | 31.0 | 44 | 26.0 |
| Sample 7 | 68 | 44.0 | 51 | 14.0 | 39 | 13.0 |
| | | Long Vari-Color Composite Yarn | | | | |
| 36" adjacent lengths of cycles | | | | | | |
| Sample 1 | 65 | | 54 | | 43 | |
| Sample 2 | 115 | 77.0 | 69 | 28.0 | 51 | 21.0 |
| Sample 3 | 59 | 95.0 | 53 | 30.0 | 42 | 21.0 |

-continued

| INVENTION YARNS | Primary Red | Red % change in adjacent lengths | Primary Green | Green % change in adjacent lengths | Primary Blue | Blue % change in adjacent lengths |
|---|---|---|---|---|---|---|
| Sample 4 | 112 | 90.0 | 70 | 43.0 | 53 | 21.0 |
| Sample 5 | 67 | 67.0 | 56 | 25.0 | 44 | 21.0 |

Generally speaking, in accordance with this invention, a higher alternating tension of the exiting crimped yarn from the stuffer box, a higher bulk in the crimped yarn, a lower process speed, and relatively more entanglement nodes per unit length in the finished composite yarn tended to produce sharper degrees of color contrast and/or shorter lengths of such contrasting sections in the finished composite yarn. Generally speaking, lower alternating tension of the exiting crimped yarn, lower bulk in the crimped yarn, higher process speed, and relatively fewer entanglement nodes per unit length in the finished composite yarn tended to produce lower degrees of color contrast and/or longer lengths of such contrasting sections in the composite yarn.

Tests were conducted which sharply differentiate this invention from other textured-air entangled multi-filament, multi-color composite yarns made from single continuous pigmented or pre-colored yarns. According to the test:

a) the subject yarn is pre-twisted with sufficient twist to expose from one side or viewpoint some portion of the total observable surface of the yarn when the subject yarn is stretched to a length of approximately ½ inch.

b) the composite pre-twisted sample yarn above is continuously wrapped around a narrow flat pallet in such a manner that each succeeding wrap is nested close to or up against its neighbors.

c) two adjacent areas exhibiting a marked color change are subjected to color analysis for their red, green and blue primary color content. In the present case, the flat colored yarn pallet colors were scanned and then imported into Adobe Photoshop 5.5 on an IBM-based PC computer. Adjacent areas of the yarn pallet were circumscribed by the software, and the histogram feature of the software gave the numerical mean red, green and blue primary color values on a scale from 0 to 255, along with the median value, standard deviation, and luminosity.

d) each adjacent area color analyzed was unwound from the pallet, extended, and measured to define its length, or its length is determined from the pallet itself by counting the number of windings and the known dimensions of the pallet in a given area.

By such test means, the present yarn invention was discovered, as shown in the Table herein, to have a significantly greater change in either the red, green, or blue primary color than corresponding color in other air entangled multi-filament textured yarns made from continuously colored strands and not space-dyed. Percentage changes in one primary color ranging from a 15% to 95% were measured as shown in the Table for the many measured samples of the composite yarns according to the present invention. A variety of other multi-color entangled yarns made from two or more continuously colored yarns via other air entangling techniques generally known to be available in the trade tested in the range of only 2% to 12% for change in either the red, green or primary blue colors.

Although FIG. 2 shows a stuffer crimper, the feed yarns can be texturized in any commercially acceptable way, such as false twisting, fluid air jet texturizing, knit-deknit or the like. Although the textured yarn is highly preferably of a single color, multiple colors may be used if desired, but may result in lower contrast results from length to adjacent length.

I claim:

1. A composite textured air-entangled multi-filament yarn, comprising the combination of at least a first feed yarn and a second feed yarn both comprising continuous filament feed yarns, each of which feed yarns is of different single color from the other, said feed yarns being longitudinally arranged in at least three zones comprising (a) a first zone wherein said first feed yarn is wrapped as a sheath around a core comprising said second feed yarn, and wherein said yarns are interlacingly entangled at nodes spaced lengthwise along said first zone, (b) a transition zone wherein said sheath yarn is submerged to a core position and said core yarn is surfaced to a sheath position, and (c) a second entanglement zone located downstream of said transition zone, wherein said second feed yarn is a sheath yarn and said first feed yarn is a core feed yarn and said yarns are interlacingly entangled at nodes spaced lengthwise along said second entanglement zone.

2. The yarn defined in claim 1 wherein said zones comprises about 5 or more entanglement nodes of interlaced filaments per meter of composite yarn length.

3. The yarn defined in claim 1, said composite yarn comprising repeated color change alternating cycles along its length.

4. The yarn defined in claim 1, wherein said zones (a) and (c) are arranged in alternating cycles having between them a lengthwise color difference of about 15–95% or more on the surface of the composite yarn, as measured by spectral analysis comparing immediately adjacent lengths (a) and (c) thereof.

5. The yarn defined in claim 4 wherein each said zones (a) and (c) have a color length between about 4 inches to about 144 inches.

6. The yarn defined in claim 5, wherein said adjacent zones (a) and (c) have lengthwise color differences of 25% or more.

* * * * *